United States Patent [19]

Abramovich

[11] Patent Number: 5,065,940

[45] Date of Patent: Nov. 19, 1991

[54] TIE PLATE RAIL FASTENING SYSTEM

[76] Inventor: Albert Abramovich, 1155 41 St., 3 Flr., Brooklyn, N.Y. 11218

[21] Appl. No.: 695,388

[22] Filed: May 3, 1991

[51] Int. Cl.[5] ..... E01B 9/04

[52] U.S. Cl. ..... 238/334; 238/332; 238/201; 238/204

[58] Field of Search ..... 238/315, 331, 332, 333, 238/334, 201, 202, 203, 204, 212

[56] References Cited

U.S. PATENT DOCUMENTS

| | | | |
|---|---|---|---|
| 90,745 | 6/1869 | Harris | 238/204 |
| 103,480 | 5/1870 | McConaughtly et al. | 238/204 |
| 148,431 | 3/1874 | Dunn | 238/204 |
| 744,606 | 11/1903 | Polster et al. | 238/333 |
| 906,015 | 12/1908 | Hauser | 238/201 |
| 1,121,215 | 12/1914 | Wieder | 238/334 X |
| 1,130,586 | 3/1915 | Freeman | 238/333 X |
| 1,182,806 | 5/1916 | Senter | 238/333 X |
| 1,260,563 | 3/1918 | McVicker | 238/333 X |
| 4,208,011 | 6/1980 | Dahlhaus et al. | 238/282 X |

FOREIGN PATENT DOCUMENTS

| | | | |
|---|---|---|---|
| 3434 | 12/1866 | United Kingdom | 238/334 |
| 105877 | 5/1917 | United Kingdom | 238/334 |

*Primary Examiner*—Robert J. Spar

*Assistant Examiner*—Craig Siavin

[57] ABSTRACT

A rail fastener includes a rail plate and a rigid stop for rail. The rail plate consists of two parts having a plane surfaces for supporting the rail and extended upward appendages bearing preferably inclined surfaces which cooperate with inclined surfaces of the rail. Each of the parts of the rail plate is placed from opposite lateral side of the rail and they both are tightened with the rail. After they are jointed, the rail fastener becomes as a single whole with rail. One of the parts of the rail plate has a recess one wall of which may be inclined. The rigid stop is mounted in advance into the support structure. When the rail with a rail plate is placed on the support structure, the recess in the rail plate straddles the rigid stop. Then a wedge is mounted into this recess. One of its ends contacts with rigid stop, other which is inclined contacts with inclined wall of the recess in the rail plate. The wedge is bolted to the support structure and pulls up the rail to the rigid stop. As two rigid stops may be mounted in one support structure in advance, their surfaces for contact with rail maintain the gage of the track, and this gage may be maintained with any required accuracy. If for any reason the gage of the track has to be adjusted, the eccentric rigid stop can be used.

5 Claims, 3 Drawing Sheets

TIE PLATE RAIL FASTENING SYSTEM

BACKGROUND OF THE INVENTION

1. Field of the Invention

This invention relates generally to a rail fastener and more particularly to a fastener for holding a rail onto a support structure which provides improved structural integrity between the rail and the support structure and improved conditions for precast manufacturing sections of railroad track with rigid assembly datum surfaces.

2. Prior Art

There are some different types of rail fasteners used on railroad tracks and described in patent literature.

Generally, they may be divided on three groups. The first is the simplest one which introduces the rail fasteners which consist of simple spikes or of special plates with spikes. The second group represents so-called direct fixation rail fasteners. For example, fasteners according U.S. Pat. Nos. 4,382,547; 4,260,105 3,858,804; and 4,917,295. To the third group relate tie plates with spring clips. For example, U.S. Pat. Nos. 4,307,837; 4,407,663.

Presently the trend in manufacturing of railroad tracks is to precast the second and the third groups of fasteners. Though these two groups are different in design, both of them have common problems. Any of known fasteners has a base plate secured to the support structure. This plate has a central recessed area adapted to receive the lower end of rail on its upper surface. In the direct fixation design rail fastener the rail is secured to the base plate by different types of hold-down plates. In the tie plates of a spring clip rail fastener the spring clips press the rail to the base plate.

As rails cannot be strictly straight and the geometry of the track isn't always straight, the recess in the base plate has more width than the width of lower end of rail. This difference in width permits placement of the rail into numbers of recesses of base plates secured to the support structures in advance. So, after assembly there are different lateral clearances in every connection of rail to base plate.

The problem is that rails in all known fasteners are permitted to move laterally. So, when a vehicle runs over a rail the lateral shear forces appear and rail moves in its clearance with impact to the vertical walls of the recesses bearing the rail. This impact produces sound and gives rise wear of the walls. As a result, the clearance becomes greater over time and the gage of the track will not be maintained. This may cause the vehicle to lose contact with the rail. Also, when rail moves, the car running over it moves laterally with rail and begins swinging.

The second problem is that the gage of the track is maintained not directly based on the rail. For this purpose they use centers of the recesses on the base plates This method cannot be very precise, because it depends of many problems which depend of quality of manufacturing and assembly.

The third problem is that such types of tie plates cannot be used on the curve section of the track, because the recesses are straight.

One more problem is that in all prior known fasteners the lateral shear forces eventually takes up the bolt which secures the tie plate to the support structure. This cannot be the best solution because the bolt tends to be selfloosening and to prevent this additional members are needed that are costly to manufacture. As to the tie plates with spring clips, the spring clip requires special equipment for its production and a special device for assembly of the spring clip with the plate and rail because the springs have a high spring constant.

SUMMARY OF THE INVENTION

It is a primary object of this invention to provide a rail fastener which becomes a single whole with the rail after they are jointed, that refuse any lateral movements of the rail inside the fastener, and make the track more reliable and durable.

A further object of the present invention is to provide such a rail fastener which provides a rigid stop for a rail which maintains the gage of the track with any required accuracy and takes up the lateral shear forces appearing when the car runs over the track.

Still another object of this invention is to provide such a rail fastener which can be adjusted when clearance in it appears.

Yet another object of the present invention is to provide such a rail fastener which can be used on any section of the track independent of the track geometry.

Still another object of the present invention is to provide such a rail fastener which makes precast manufacturing much easier and cheaper.

A related object of the present invention is to provide such a rail fastener which prevents the car, running over it, from swinging excessively which makes car more reliable and durable and decreases the level of noise.

BRIEF DESCRIPTION OF THE DRAWINGS

Like reference numerals throughout the various views of the drawing are intended to designate the same elements.

DETAILED DESCRIPTION OF THE PREFERRED EMBODIMENT

Figure 1:
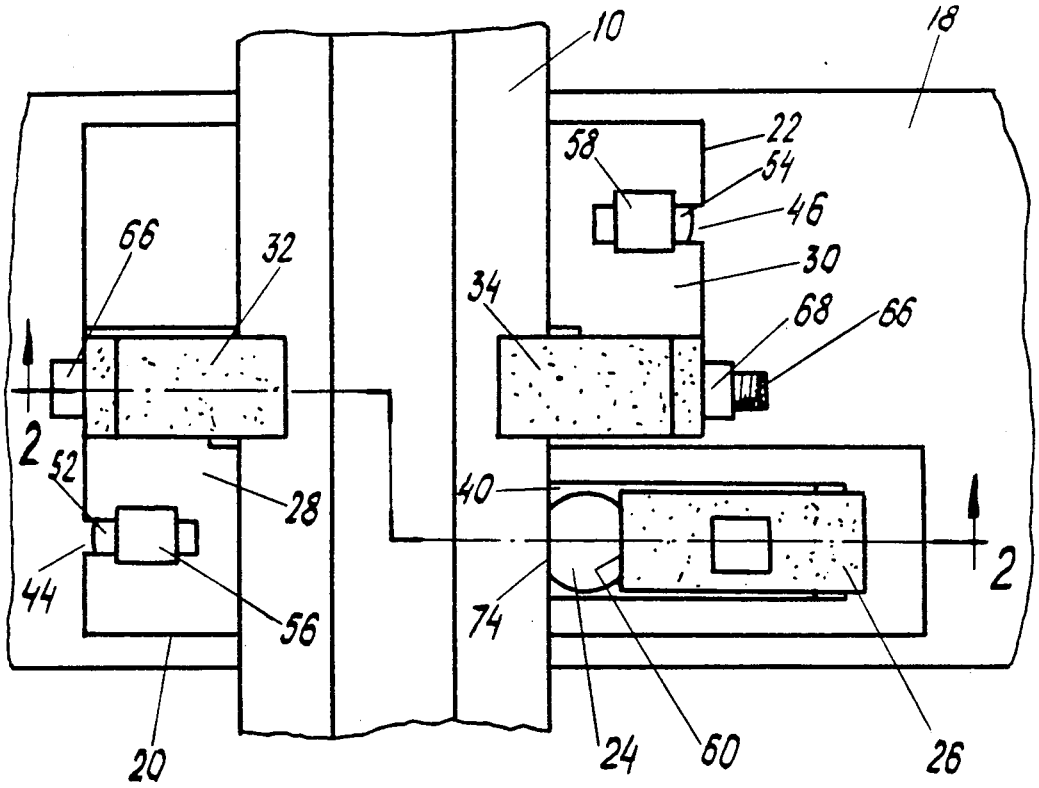
FIG. 1 is a plan view of a rail fastener constructed in accordance with the principles of the present invention.
Figure 2:
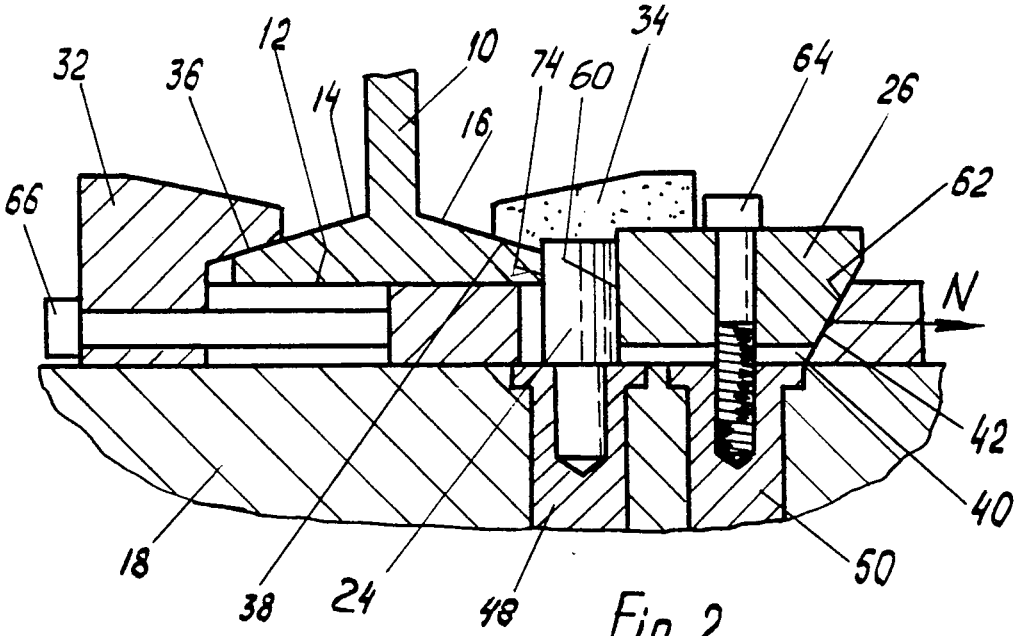
FIG. 2 is a sectional view taken along line 2—2 of FIG. 1.
Figure 3:
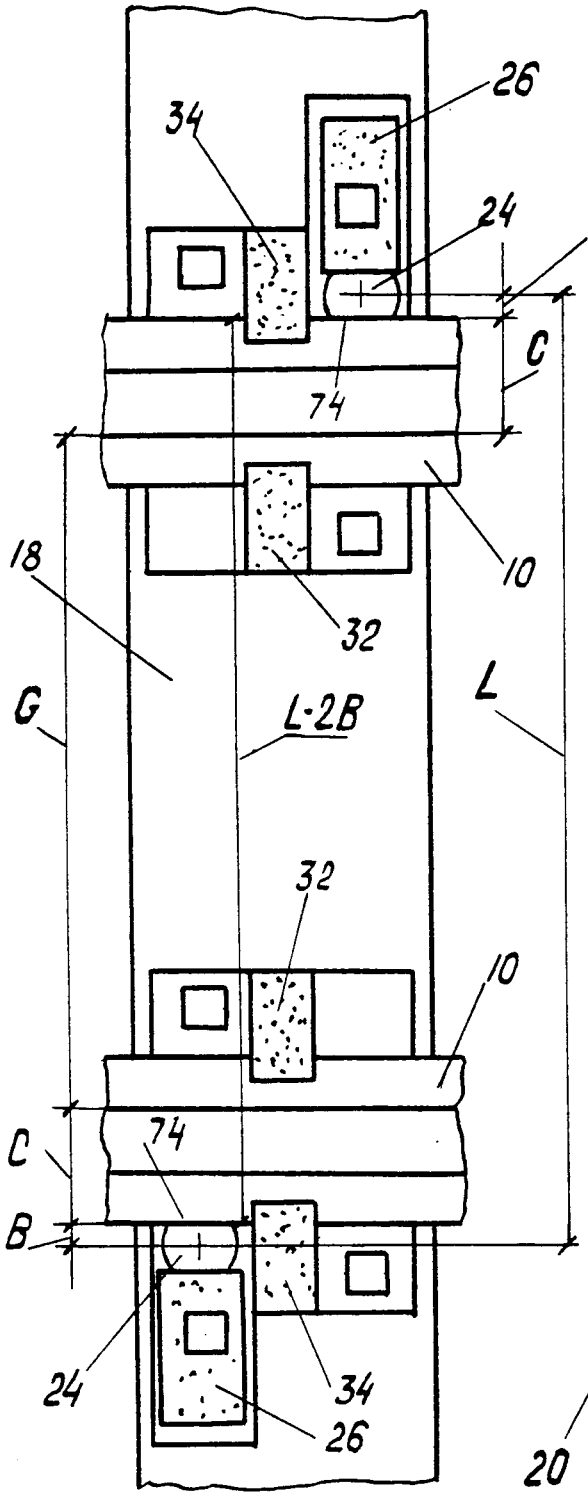
FIG. 3 is a plan view of two rail fasteners base illustrated in FIGS. 1 and 2 mounted on one support structure.
Figure 4:
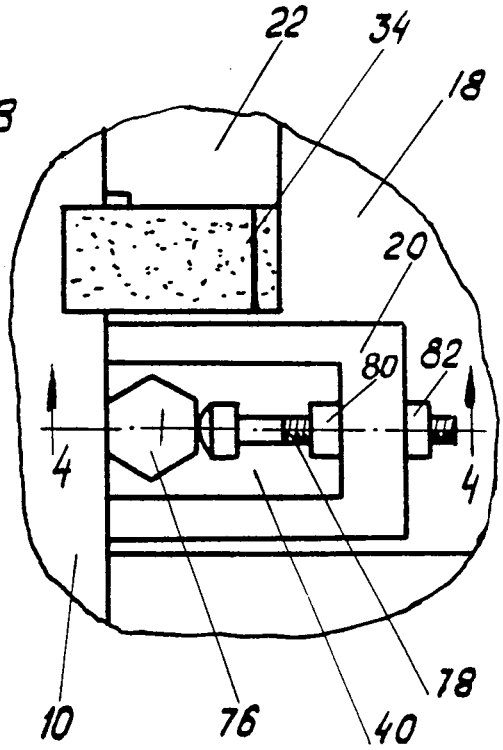
FIG. 4 presents a modified form of a rigid stop and a mechanism for pulling up the rail with a rail plate to the rigid stop; plan view.
Figure 5:
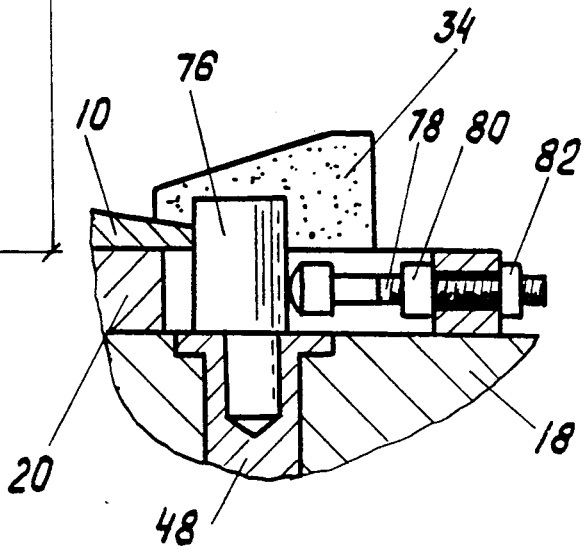
FIG. 5 is a sectional view taken along line 4—4 of FIG. 4.
Figure 6:
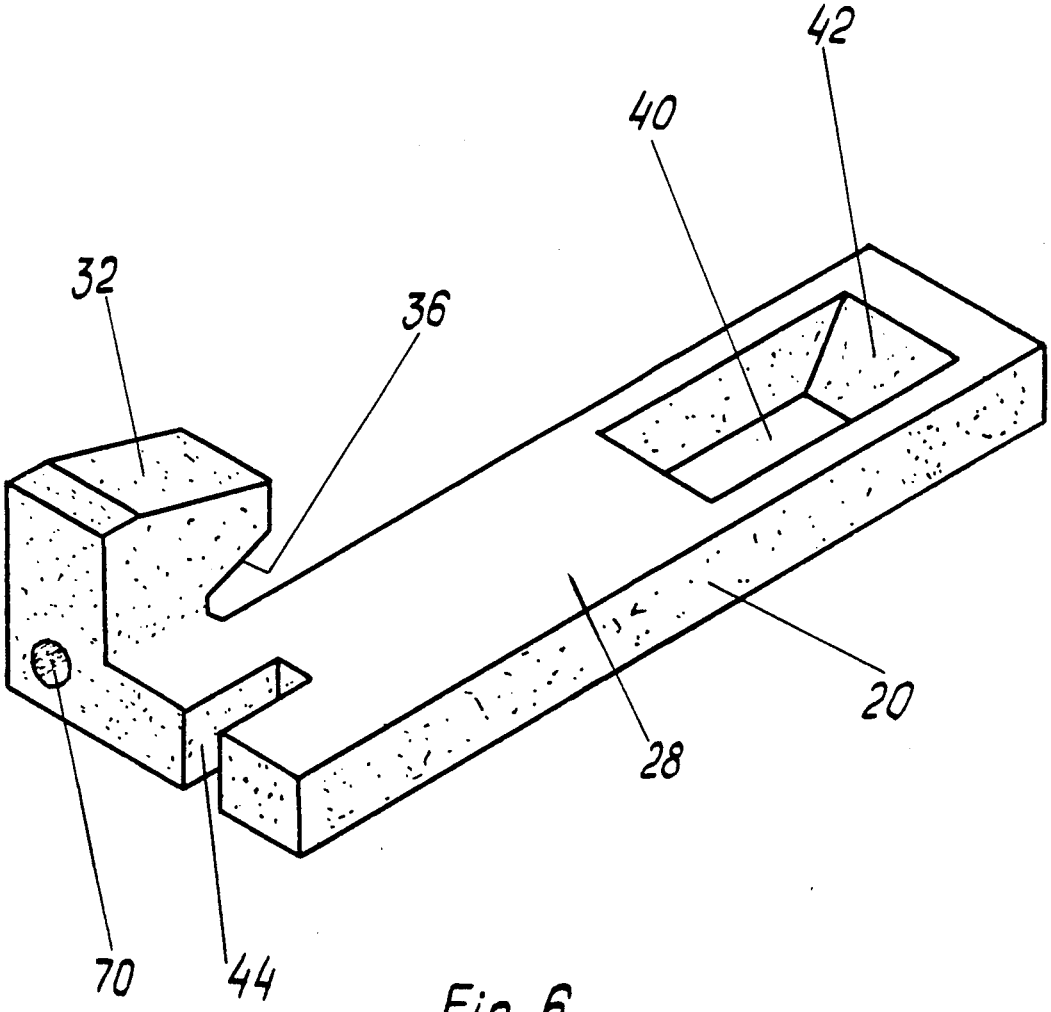
FIG. 6 represents an axonometric view of the rail plate.

With reference to FIGS. 1, 2, 3, 4 and 5 there is shown a rail fastener which is constructed in accordance with the principles of the present invention for holding a rail 10 having a plane lower end 12 and two inclined surfaces 14 and 16 onto support structure 18.

The fastener generally includes two rail plates 20 and 22, a rigid stop 24, and a wedge 26. Each of the rail plates 20 and 22 has a plane part 28 and 30 respectively and an appendage 32 and 34 respectively having inclined surfaces 36 and 38. The rail plate 20 has a recess 40 one wall 42 of which is also inclined in such way that the lower size of recess 40 is less than the upper size. Both rail plates 20 and 22 have grooves 44 and 46 respectively.

the rigid stop 24 is mounted in an insert 48 which is mounted into the support structure 18. Into the support structure 18 also are mounted inserts 50, 52, and 54. Bolts 56 and 58 are used to secure rail plates 20 and 22 to the support structure 18.

The wedge 26 has a narrow lower end wide upper end; one of the lateral side 60 is straight, other side 62 is inclined. The wedge 26 is placed into the recess 40 of the plate 20 between the rigid stop 24 and the inclined wall 42 of the recess 40 and bolt 64 holds it down. A bolt 66 and a nut 68 are used to tighten both rail plates 20 and 22 with rail 10. There are holes 70 and 72 in the appendixes 32 and 34 for bolt 66. There is a preferred sequence for assembly of the present fastener.

Rail plates 20 and 22 are placed from opposite sides of the rail 10 in such position that the lower end 12 of the rail 10 is onto the plane surfaces 28 and 30 of the rail plates 20 and 22 and its inclined surfaces 14 and 16 cooperate with inclined surfaces 36 and 38 of the rail plates 20 and 22 respectively. In this case bolt 66 and nut 68 may be used for tightening both rail plates 20 and 22 with rail 10. Thus, the rail plates 20 and 22 and rail 10 become as a single whole. It looks now like a rail with many 'feet' along its length. Independently, the inserts 48, 50, 52, and 54 are mounted into the support structure 18, and the rigid stop 24 is mounted into the insert 48. Then, the support structures 18 may be positioned with required distances and geometry of the track. The geometry of the track is mounted according surfaces 74 of the rigid stops 24 mounted in every support structure 18. After the geometry of section of the track is set up, the rail 10 with its 'feet' is placed onto all support structures 18 in such way that recesses 40 in the rail plates 20 straddle the rigid stops 24. Then, the wedge 26 is mounted inside the recess 40 with its narrow end down. Its straight side 60 is in contact with the rigid stop 24, its inclined side 62 is in contact with inclined wall 42 of recess 40. When bolt 64 begins to hold the wedge 26 down, more wide part of the wedge 26 comes in contact between the rigid stop 24 and inclined wall 42 of the recess 40. In that case the lateral force N occurs between inclined surfaces 58 and 42. As rigid stop 24 cannot move, so the force N makes the rail plate 20 together with rail 10 and other rail plate 22 moving in the direction of the force N. This unit moves laterally until the rail 10 will reach contact with surface 74 of the rigid stop 24. When this contact appears, the movement of the unit of the rail plates 20 and 22 and rail 10 terminates, and entire system of the rail 10, rail plates 20 and 22, rigid stop 24, wedge 26, and support structure 18 gets structural integrity. Bolts 56 and 58 hold down both rail plates 20 and 22. The second rail 10 of the track is mounted at the same way and the gage of the track is appeared automatically because two rigid stops 24 on the same support structure 18 are mounted into two inserts 48 which are positioned with high accuracy into the support structure 18. As it is shown on FIG. 3 the gage G=L-2B-2C, where 'B' is a distance of the surface 74 from the center of the insert 48, and 'C' is one of standard dimensions of the rail 10, and 'L' is spacing on centers between two inserts 48. Eventually, the dimension (L-2B) makes the gage of the track. Modern technology allows to make these dimensions with any required accuracy. If for any reason the gage of the track requires to be adjusted during the assembly, other type of rigid stop can be used. On FIGS. 4 and 5 this type of rigid stop is presented. The rigid stop 76 is eccentric. When the adjustment is required it is enough to use rigid stops 76 only for one rail of the track. When the geometry for the first rail 10 of the track is mounted by positioning of the support structures 18 with rigid stop 24, rigid stop 76 may be used for maintaining the dimension 'L-2B' by rotation of the eccentric. There is another mechanism for pulling up the rail 10 with rail plate 20 to the rigid stop 24 or 76 shown on FIGS. 4 and 5, comprising of a screw 78 and a nut 80. A nut 82 is used only for locking the screw 78 when it is tightened. To pull up the rail 10 with rail plate 20 to the rigid stop 24 the screw 78 has to be removing of the nut 80. In this case, the head 84 of the screw 78 will be rested against the rigid stop 24, and the nut 80 will move rail plate 20 with the rail 10 resting against the wall of the recess 40 until the rail 10 will reach the rigid stop 24. Then, when the integrity between rail 10 and rigid stop 24 will be reached the nut 82 has to be tightened to secure this positon.

If for any reason the clearance appears in the fastener between the rail 10 and rail plates 20 and 22 there is a possibility to adjust this fastener. For adjustment they have to slacken bolts 56 and 58 then to hold down the bolt 64 and nut 68 and then to tighten bolts 56 and 58 again.

Thus, the present fastener provide the whole integrity between rail 10 and rail plates 20 and 22 and support structure 18. So, when the car runs over this track the rigid stop 24 or 76 takes up the shear forces occurring and the appendage 32 takes up overturning moment to which the rail is subjected by the car's wheel flange.

In addition, to attenuate vibration of the rail surfaces of the fastener being in contact with rail such as 28, 30, 36, 38, and 74 may be covered by elastomeric material, for example polyurethane, if structural integrity of the fastener, rail and support structure will be not enough for any reason.

The invention claimed is:

1. A rail fastener for supporting a rail having a foot on a support structure and maintaining the gage of a track comprising;

a rail plate consisting of two parts, each part having a planar upper surface for supporting the rail and an upwardly extending appendage, each appendage having an inclined surface for contact with a corresponding inclined surface on the foot of the rail whereby said parts are placed side by side with an appendage on opposite lateral sides of the rail, and means for tightening said parts to said rail;

a rigid stop mounted into the support structure which contacts the rail;

means for pulling said rail plate and said rail towards said rigid stop; and an opening in a part of said rail plate in which said rigid stop and said means for pulling are located.

2. the rail fastener of claim 1, wherein an inclined wall forms an outer portion of said opening and said means for pulling comprises a wedge which contacts said rigid stop on one side and contacts said inclined wall on the other.

3. The rail fastener of claim 1, wherein said means for pulling comprises a nut and bolt arrangement mounted on an outer wall of said opening and whereby said bolt is rested against said rigid stop to exert a force thereon.

4. The rail fastener of claim 2, wherein said rigid stop is eccentric.

5. The rail fastener of claim 3, wherein said rigid stop is eccentric.

* * * * *